US008050440B2

(12) United States Patent
Rafferty

(10) Patent No.: US 8,050,440 B2
(45) Date of Patent: Nov. 1, 2011

(54) HEARING AID THAT FACILITATES REMOVAL OF EARWAX AND TRAPPING OF MOISTURE

(76) Inventor: Richard A. Rafferty, Summit, NJ (US)

( * ) Notice: Subject to any disclaimer, the term of this patent is extended or adjusted under 35 U.S.C. 154(b) by 273 days.

(21) Appl. No.: 10/579,426

(22) PCT Filed: Nov. 12, 2004

(86) PCT No.: PCT/US2004/037733

§ 371 (c)(1),
(2), (4) Date: May 12, 2006

(87) PCT Pub. No.: WO2005/051040

PCT Pub. Date: Jun. 2, 2005

(65) Prior Publication Data

US 2007/0086611 A1 Apr. 19, 2007

(51) Int. Cl.
*H04R 25/00* (2006.01)

(52) U.S. Cl. ..... 381/328; 381/325; 381/324

(58) Field of Classification Search ..... 381/60, 381/322, 324, 325, 328, 380, 382; 181/129, 181/130, 135

See application file for complete search history.

(56) References Cited

U.S. PATENT DOCUMENTS

| | | | | | |
|---|---|---|---|---|---|
| 4,763,752 | A | * | 8/1988 | Haertl et al. | 181/130 |
| 4,870,688 | A | * | 9/1989 | Voroba et al. | 381/60 |
| 4,870,689 | A | | 9/1989 | Weiss | |
| 4,987,597 | A | * | 1/1991 | Haertl | 381/325 |
| 5,278,360 | A | * | 1/1994 | Carbe et al. | 181/135 |
| 5,327,500 | A | * | 7/1994 | Campbell | 381/325 |
| 5,530,763 | A | | 6/1996 | Aebi et al. | |
| 5,970,157 | A | | 10/1999 | Yoest | |

* cited by examiner

*Primary Examiner* — Huyen D Le

(74) *Attorney, Agent, or Firm* — Alan Taboada; Moser Taboada

(57) ABSTRACT

A hearing aid (2) is provided which includes a receiver tube (14) containing waterproof ear wax mesh trap (16). The receiver tube is removably connected directly to the hearing aid receiver (12) and the tube may be cleaned or replaced by a hearing aid dispenser or audiologist during a patient office visit. The receiver tube includes a waterproof ear wax trap lodged within, that is made of a foamed and stretched PTFE membrane. Further, the length of the receiver tube may be adjusted by the dispenser or audiologist during the office visit by clipping it accordingly.

8 Claims, 6 Drawing Sheets

HEARING AID THAT FACILITATES REMOVAL OF EARWAX AND TRAPPING OF MOISTURE

FIELD OF THE INVENTION

The present invention relates to an in-the-ear hearing aid comprising an ear wax trap in a receiver tube that stops the moisture damage to hearing aid receivers.

BACKGROUND OF THE INVENTION

Conventional methods of removing earwax (cerumen) from hearing aids are non-efficient and expensive in that, when a hearing aid becomes clogged with earwax and no longer works optimally, neither the wax nor moisture can be removed or trapped by the hearing aid wearer or the hearing aid dispenser.

THE PRIOR ART

In the prior art, a partial sectional/three dimensional view of a conventional hearing aid 2 is shown in FIG. 1. With reference to FIG. 1, a conventional hearing aid is constructed in a manner wherein hearing aid receiver 4 and receiver tube 6, which functions as a sound wave guide, are permanently joined together so as to form a single unit. Receiver tube 6 includes ear insertion end 8 for insertion into the hearing aid wearer's ear canal. Mesh 10 is lodged within receiver tube 6 to prevent earwax from traveling down tube 6 from insertion end 8 and clogging the acoustic transducer (not shown) within receiver 4. While a permanently joined receiver 4 and receiver tube 6 helps stabilize receiver tube 6 within the ear canal, such hearing aid construction does not permit the easy removal of ear wax from hearing aid 2.

U.S. Pat. No. 5,982,908 discloses a fixed receiver tube which is lined with a removable tube that includes an ear wax trap. The removable tube may be removed as needed from the fixed tube to clean the sound transparent ear wax trap which is a net made of plastic mesh or a re-washable fabric material, after which it may be reinserted into the fixed tube of the hearing aid. The removable tube may be secured to the fixed tube by engaging threaded portions located on the tubes. Alternatively, this patent discloses securing the fixed tube to the removable tube by means of one or more mating cams for engaging cammed shoulders; joining the tubes together with an adhesive; or by employing plastic cammed shoulders and mating cams which can be snapped together and pulled apart.

Given the miniaturized dimensions of hearing aids, a need exists to have a practical means to couple and decouple a removable tube that comprises an earwax trap capable of the dual function of trapping the earwax and preventing moisture from damaging the acoustic transducer of the hearing aid; especially since the fumbling involved with attempting to join portions of two small tubes together often leads to breakage of the fixed tube; loss of the removable tube; and great difficulty in joining the two tubes together.

Hearing aids are constructed so that the receiver tube is glued to the hearing aid's receiver. Approximately eighty percent of manufacturers' hearing aid repairs are due to wax and moisture in the receiver and tubing. This wax and moisture cannot be removed by the hearing aid wearer nor the hearing aid dispenser. While there are wax guard systems, they are inadequate because they do not stop moisture damage to hearing aid receivers. Some of these systems require the end user to have a high degree of fine motor skills and dexterity, which is a problem for the elderly population. Also, about eighty percent of repairs still involve receivers and receiver tubes.

This invention resolves this problem, by eliminating costly repairs by enabling the hearing aid dispenser to repair hearing aids in the office in a matter of minutes. Currently, hearing aids must be returned to the manufacturers for repair, in large measure due to moisture damage, causing the wearer to be without the hearing aid for a period of one to two weeks. This invention enables preventive maintenance, i.e. changing of the receiver tube every three to six months because of improvement against earwax clogging and moisture damage, thereby making hearing aids more reliable and potentially increasing the number of hearing aid wearers.

SUMMARY OF THE INVENTION

It is an object of the present invention to provide an in-the-ear hearing aid characterized by dual improvements against earwax clogging and moisture damage, comprising:

a receiver; a receiver tube removably connectable to said receiver; and a water-proof ear wax trap located within the receiver tube.

Applicable reference numbers have been carried forward.

DETAILED DESCRIPTION OF THE INVENTION

A hearing aid is provided according to the invention, having a receiver tube which is removably connected to a hearing aid receiver. The receiver tube includes a water proof ear wax collecting mesh which prevents ear wax from clogging the hearing aid receiver. The receiver tube which also functions as a sound wave guide can be trimmed in length according to need by the hearing aid dispenser/audiologist during a patient office visit, using suitable cutting tools. More importantly, the receiver tube can be replaced or cleaned by the dispenser/audiologist during a patient office visit should the tube become clogged with earwax. It is further contemplated that the receiver tube contained the water proof earwax trap according to the invention can be sold to audiologists, hearing aid dispensers or to the public for ready replacement of a receiver tube which has been clogged with earwax. The features described in this paragraph apply to all embodiments of the subject invention.

Figure 1:
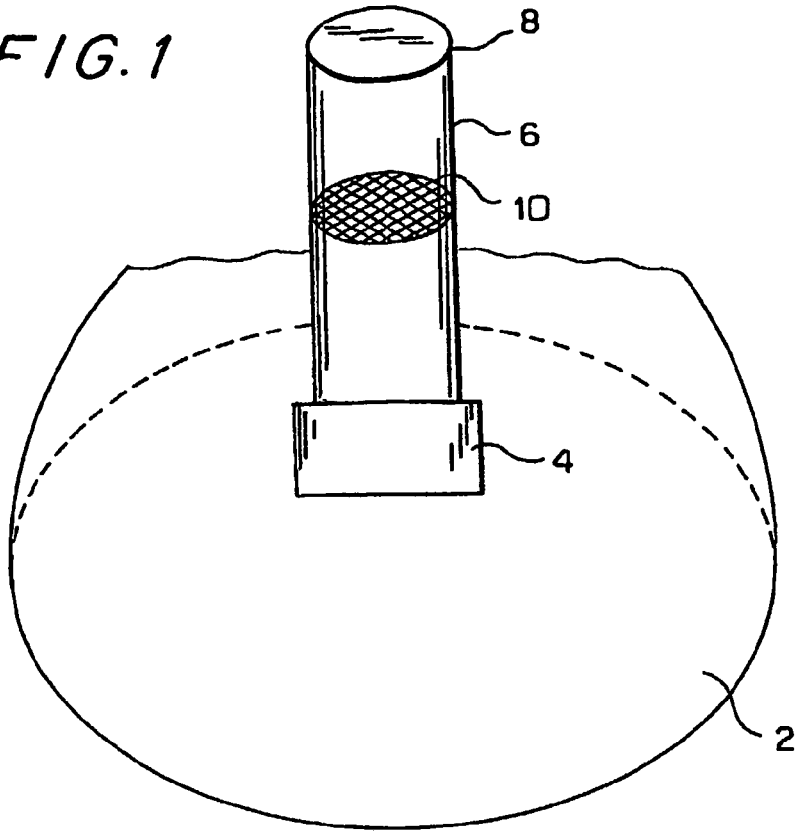
FIG. 1 illustrates a partial sectional/three dimensional view of a conventional hearing aid.
Figure 2:
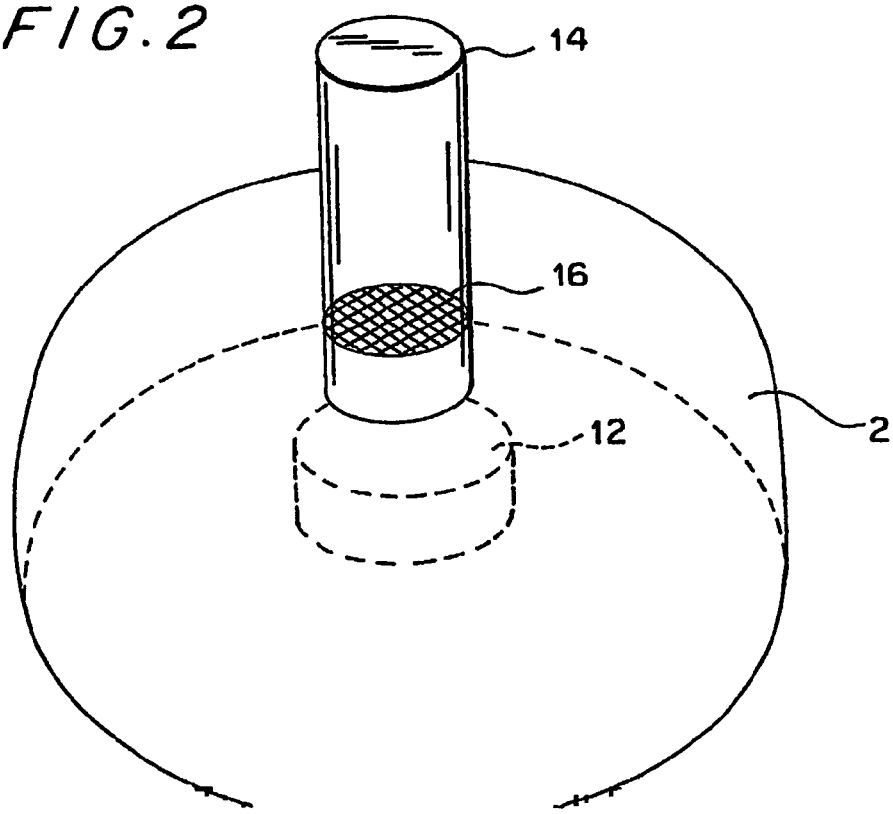
FIG. 2 illustrates a partial sectional/three dimensional view of a first preferred embodiment according to the invention.

FIG. 2 illustrates a partial sectional/three dimensional view of a first preferred embodiment according to the invention. With reference to FIG. 2, hearing aid 2 includes receiver 12 and receiver tube 14 which is removably connected to receiver 12. The waterproof earwax mesh trap 16 is lodged within tube 14 and it serves as an ear wax trap to prevent ear wax from reaching receiver 12 which includes an acoustic transducer (not shown). Additionally, the hearing aid includes a microphone, power source and volume control (all not shown) coupled to receiver 12. The waterproof earwax mesh trap 16 is made of a foamed and stretched PTFE that is characterized by very fine pores, and carries the trademark GORE-TEX. The GORE-TEX membrane of foamed and stretched pure polytetrafluoroethylene (PTFE) is a microporous membrane containing more than nine billion pores per square inch. Each pore is 20,000 times smaller than a drop of water which makes the fabric or mesh to which it is laminated waterproof.

Figure 3:
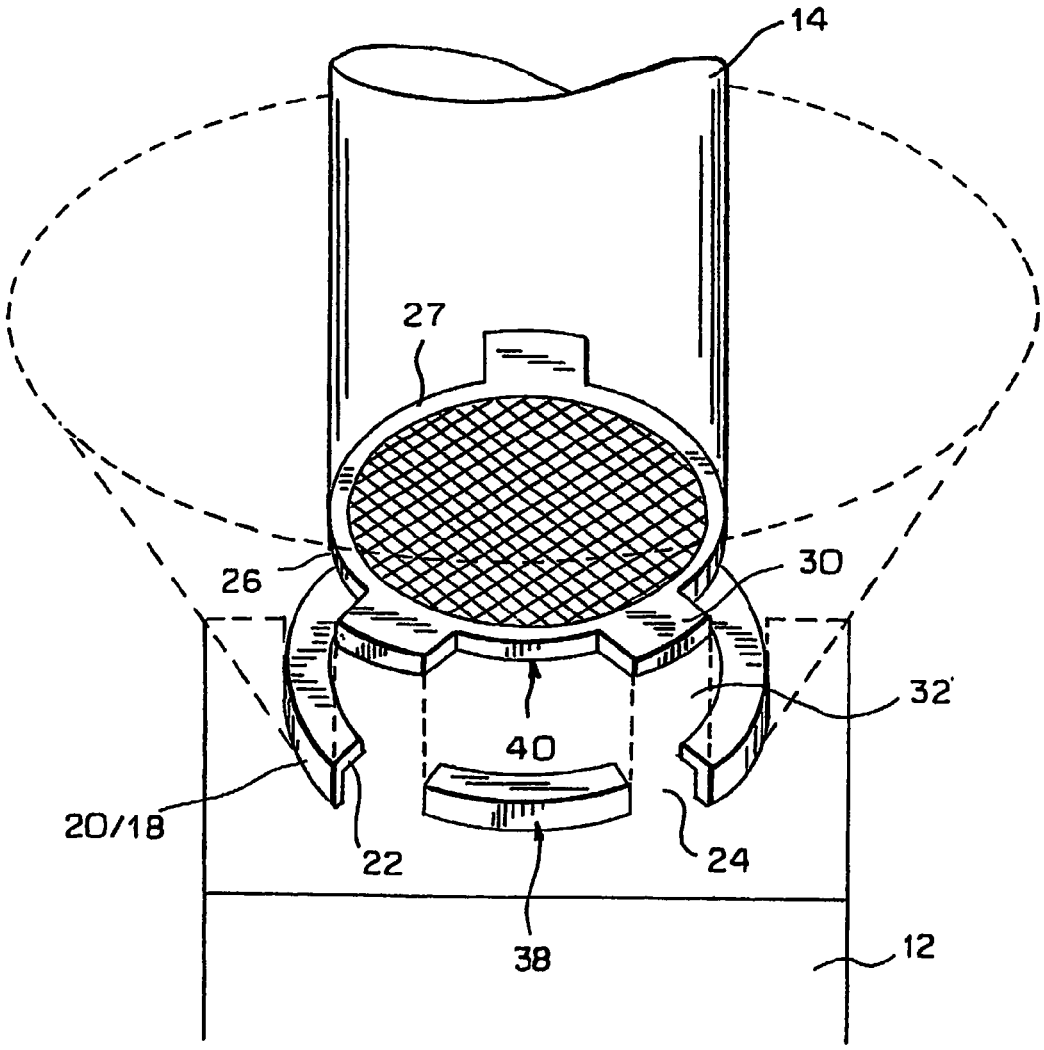
FIG. 3 illustrates a partial sectional/three dimensional view of a second preferred embodiment of the invention.

FIG. 3 illustrates a partial sectional/three dimensional view of a second preferred embodiment of the invention. Encircling receiver 12, at aperture end 13, in a radial plane thereof is an annular locking rib 18 of substantially constant radial dimension having an upwardly presented and upwardly convergent cam surface 20 thereon and an abruptly angled (e.g., substantially perpendicular with respect to cam surface 20) lower annular face 22 which in the present embodiment is in substantially a radial plane for positive holding engagement with the cooperating portion of receiver tube 14 as hereinafter described. More than one annular face 22 is present in this second preferred embodiment of the invention. As shown in FIG. 3, locking rib 18 includes at least one gap 24 therethrough defined by annular face(s) 22. Receiver tube 14 when applied to aperture end 13 of receiver 12 is rotatable thereon about the axis of receiver 12. Receiver tube 14 includes a cylindrical skirt 26. At least one locking lug 30, on said cylindrical skirt, projects radially inwardly from one side of skirt 26 for locking reception beneath locking rib 18 of receiver 12. Rotation of receiver tube 14 can angularly orient tube 14 so as to bring locking lug 30 into alignment and registry with gap 24 through locking rib 18, lug 30 being proportioned for free movement vertically through gap 24 to permit removal of receiver tube 14 from engagement with aperture end 13 of receiver 12. Cylindrical skirt 26 has radially inwardly projecting annular rib 27 integral therewith around its inner periphery in the same radial plane as lug 30 and in spaced relation from plane 32 through receiver 12, such that when receiver tube 14 is operatively applied to aperture end 13 of receiver 12, ribs 18 and 27 cooperate to press receiver tube 14 into sealing engagement with receiver 12 such that annular end 13 lies in plane 32. Rotation of receiver tube 14 so as to move lug 30 out of alignment with gap 24 serves to secure receiver tube 14 to receiver 12. Receiver tube 14 is formed of a suitable plastic or other material having sufficient elastic resiliency that skirt 26 and rib 27 are elastically expansive for snap-fitting of rib 27 over locking rib 18. Thereafter, expanded skirt 26 and its rib 27 will resiliently contract beneath locking rib 18. In order to remove receiver tube 14 from receiver 12 at alignment end 13, tube 14 can be rotated to its removal position such that lug 30 aligns and registers with gap 24. Such position can be determined either by sense of touch or by means of aligning indicia arrow 38 with indicia arrow 40. With receiver tube 14 thus oriented, it is then necessary to apply but a moderate amount of upward finger pressure to urge lug 30 through gap 24.

Figure 4:
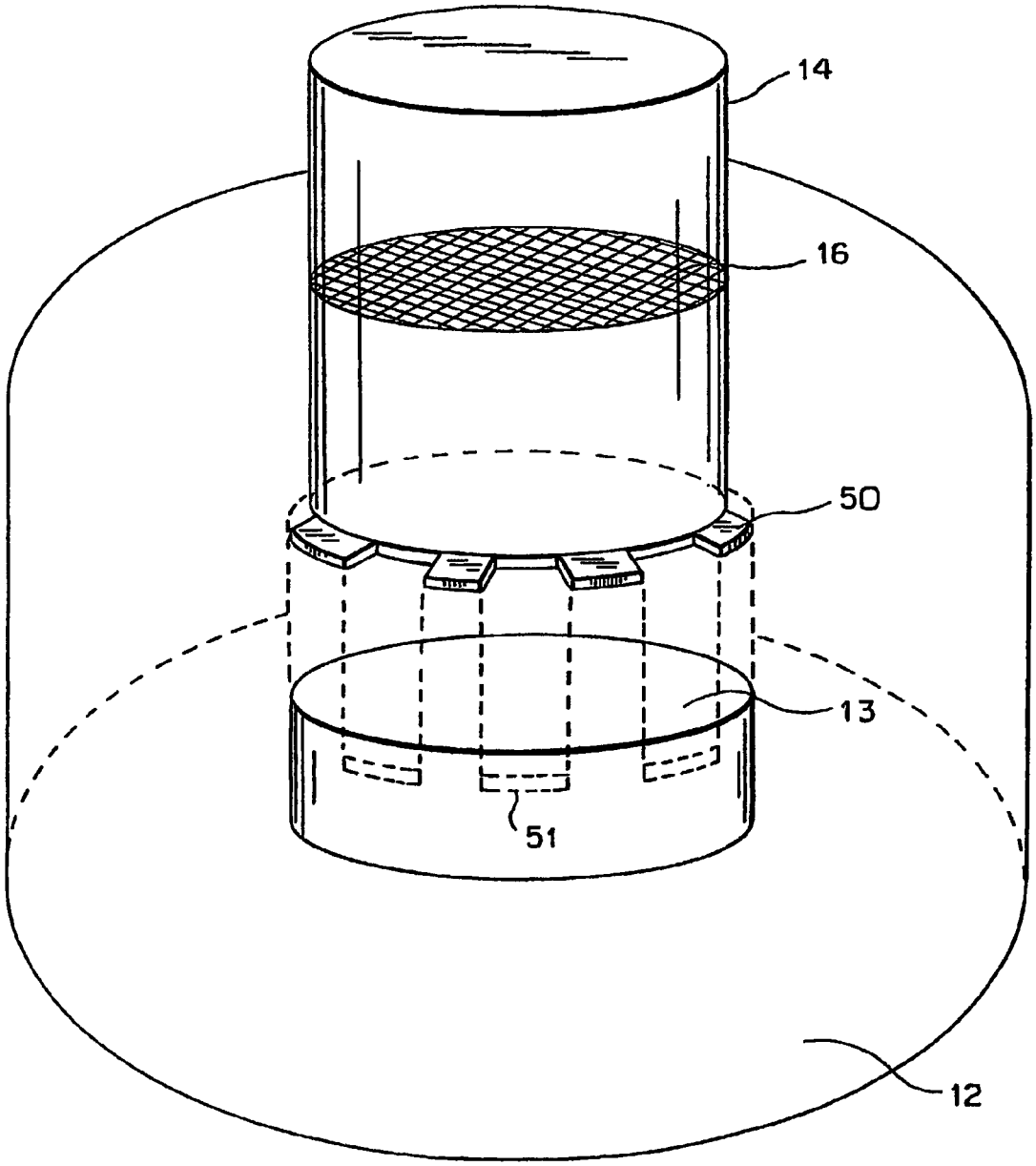
FIG. 4 illustrates a partial sectional/three dimensional view of a third preferred embodiment of the invention.

FIG. 4 illustrates a partial sectional/three dimensional view of a third preferred embodiment of the invention. Receiver tube 14 includes a plurality of phalanges 50 located along the perimeter of tube 14 and extending radially from its center axis. Phalanges 50 are flexible and deformably resilient so as to bend when engaging receiver tube 14 with receiver 12 at its aperture end 13. Phalanges 50 flex and grip the interior of receiver 12 at aperture 13 so as to adhere receiver tube 14 to receiver 12. Receiver 12 may optionally include a plurality of raised grooves, bumps or cooperating phalanges (all represented by symbols 51) at its aperture end 13 to assist in securing receiver tube 14 to receiver 12.

Figure 5:
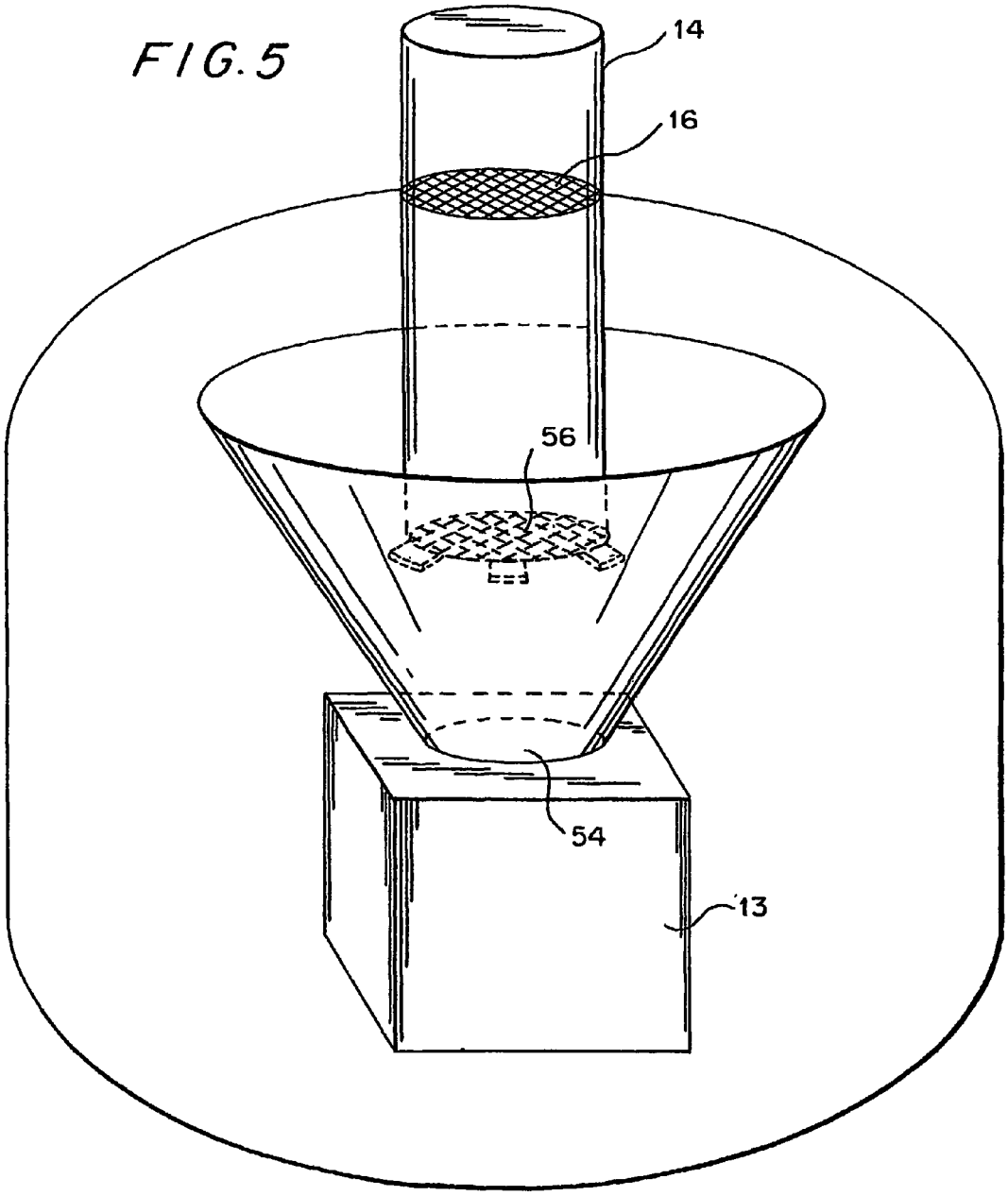
FIG. 5 illustrates a three-dimensional view of a fourth preferred embodiment of the invention.

FIG. 5 illustrates a three-dimensional view of a fourth preferred embodiment of the invention. Receiver 12 includes a conically-shaped aperture end 13, in the form of a funnel, having a tapered cross-section in the direction toward the aperture, which serves to guide receiver tube 14 into locking engagement with receiver 12. Receiver 12 includes threads 54 located near the aperture end of receiver 12. Receiver tube 14 includes cooperating threads 56 which is capable of being secured to aperture end 13 of receiver 12 in conjunction with cooperating threads 54. The small dimensions of a hearing aid in relation to the human ear are well accommodated by the funnel-shaped aperture end 13 which provides directional guidance of receiver tube 14 into locking engagement with receiver 12 with a twist of the fingers. This allows receiver tube 14 to be removably screwed on to receiver 12 at aperture end 13. The conical shape of aperture end 13 provides precision engagement of receiver tube 14 with receiver 12 in a manner similar to that used to accomplish in-flight refueling of aircraft whereby the refueling tube of the tanker craft engages a conically-shaped receptor of the aircraft to be refueled.

Figure 6:
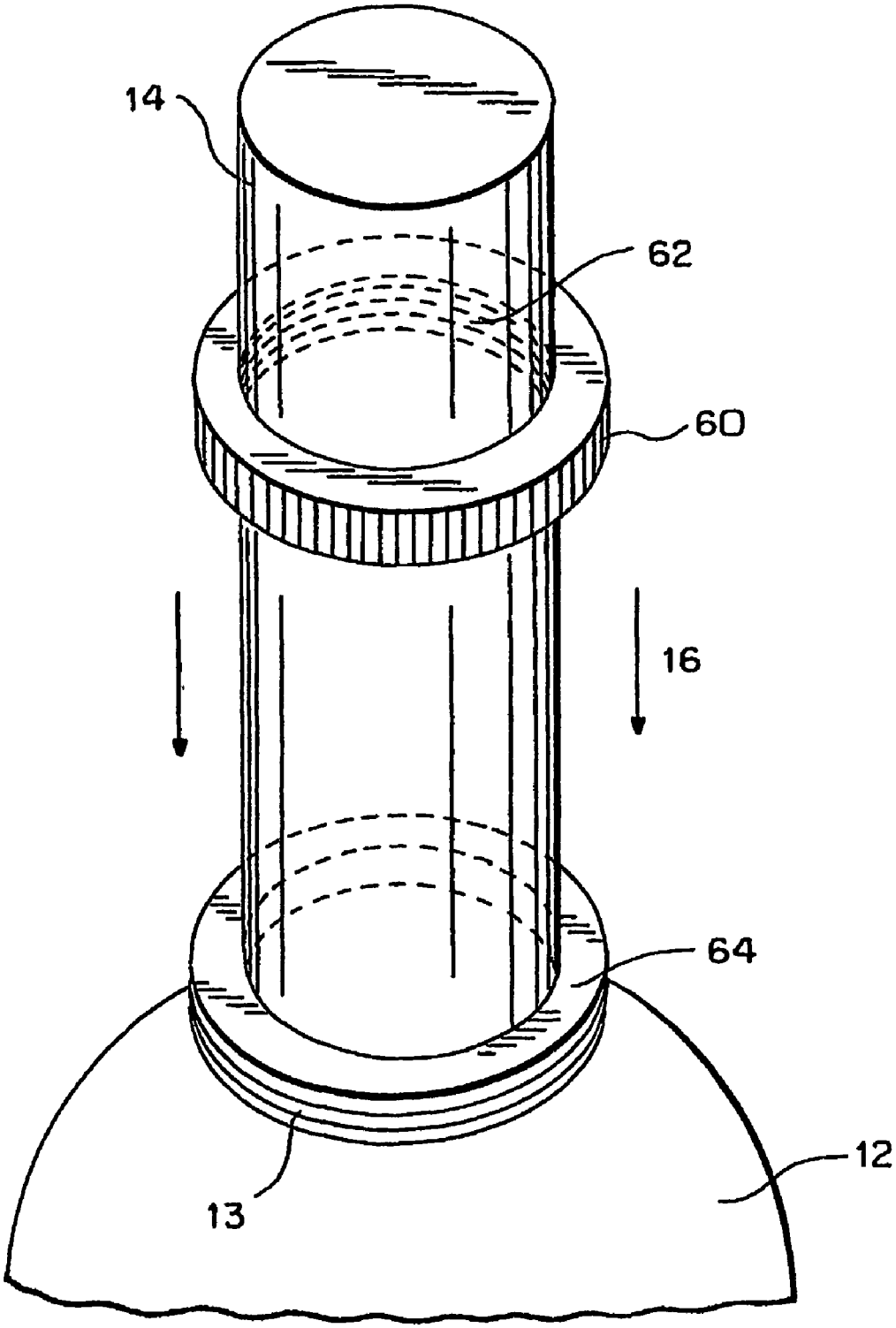
FIG. 6 illustrates a three-dimensional view of a fifth preferred embodiment of the invention.

FIG. 6 illustrates a three-dimensional view of a fifth preferred embodiment of the invention. Receiver tube 14 is removably secured to aperture end 13 of receiver 12 with sliding ring or cap 60. Sliding ring 60 includes a threaded portion 62 on an interior perimeter of ring 60 for engagement with cooperating threads 64 on aperture end 13.

Figure 7:
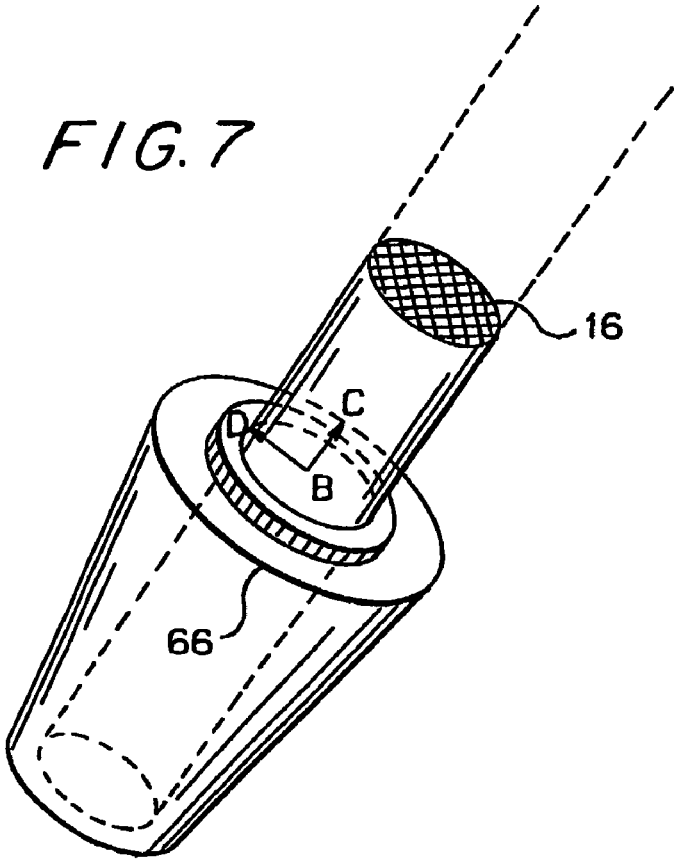
FIG. 7 illustrates a three-dimensional view of the receiver tube according to the fifth preferred embodiment of the invention.

FIG. 7 illustrates a three-dimensional view of receiver tube 14 according to the sixth preferred embodiment of the invention. As shown, receiver tube 14 extends from a plane through point B, lying along the radial axis of tube 14. Receiver tube 14 includes a hollow center of radius BD and a flanged end 66 of radius BC. With reference to FIGS. 6 and 7, sliding cap 60 can slide along and be positioned coaxially with tube 14. The sliding motion is stopped by flanged end 66 of receiver tube 14. Sliding cap 60 can be removably screwed onto receiver 12 as its threads 62 removably lock into cooperative engagement with cooperating threads 64 on aperture end 13 of receiver 12, to removably join receiver 12 to receiver tube 14.

Figure 8:
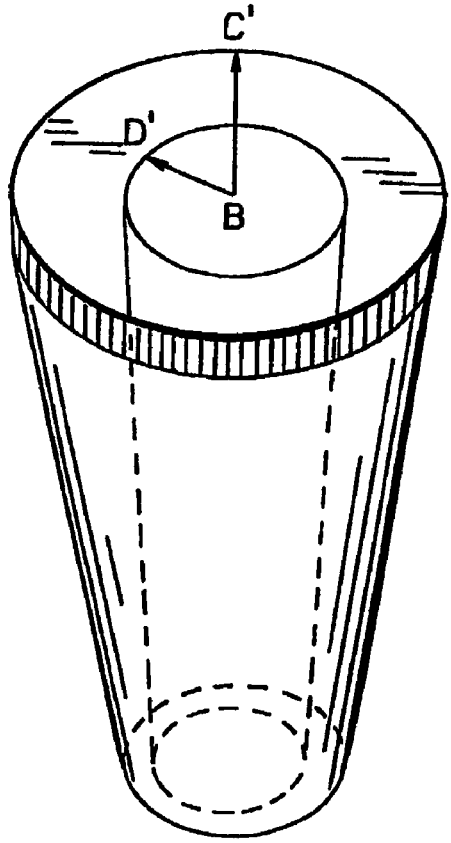
FIG. 8 illustrates a three-dimensional view of the sliding cap of the fifth preferred embodiment of the invention.

FIG. 8 illustrates a three-dimensional view of sliding cap 60 according to the fifth preferred embodiment of the invention. Sliding cap 60 includes a hollowed portion of radius BD' which is substantially equal to or greater than radius BD, the hollow center of receiver tube 14. Radius BD' is less than radius BC of flanged end 66 and radius BC is substantially equal to or less than radius BC', the radius of sliding cap 60. With reference to FIGS. 6, 7 and 8, these relative radii dimensions prevent cap 60 from sliding completely off of receiver tube 14 at flanged end 66. Sliding ring 60 holds receiver tube 14 in place on aperture end 13 of receiver 12 in a manner similar to the way a conventional baby bottle nipple is held in place with a locking ring on a baby bottle.

Although the invention has been described in detail herein with reference to its preference embodiment, it is to be understood that this description is by way of example only and it is not to be construed in a limiting sense. It is to be further understood that numerous changes in the details of the embodiment of the invention, and additional embodiments of the invention, and additional embodiments of the invention, will be apparent to, and may be made by persons of ordinary skill in the art having reference to this description. It is contemplated that all such changes and additional embodiments are within the true scope and spirit of the invention as claimed below.

I claim

1. An apparatus, comprising:

a receiver tube that is removably connectable to a hearing aid and removably connectable to a receiver of the hearing aid, wherein the receiver tube includes a plurality of lugs radially extending from an end of the receiver tube to interface with a locking rib disposed about the receiver such that the receiver tube may be connected to or removed from the receiver when in a first position, and locked to the receiver when the receiver tube is rotated to a second position relative to the receiver; and an ear wax trap comprising a microporous membrane, wherein the ear wax trap is disposed within the receiver tube.

2. The apparatus of claim 1, wherein the microporous membrane comprises foamed and stretched polytetrafluoroethylene.

3. The apparatus of claim 2, wherein the foamed and stretched polytetrafluoroethylene contains approximately 9 billion pores per square inch or more.

4. The apparatus of claim 1, wherein the microporous membrane comprises micro-pores having a size that substantially limits the passage of water through the membrane.

5. The apparatus of claim 1, wherein the ear wax trap is waterproof.

6. The apparatus of claim 1, wherein the receiver has an opening and wherein the receiver tube is removably coupled to the receiver about the opening, and further comprising:

a funnel disposed about the opening of the receiver and configured to guide the receiver tube into the opening.

7. An apparatus, comprising:

a hearing aid comprising a receiver having an opening;

a receiver tube that is removably coupled to the hearing aid and removably coupled to the receiver about the opening, wherein the receiver tube includes a plurality of lugs radially extending from an end of the receiver tube;

a locking rib disposed about the opening of the receiver to allow the receiver tube to be connected to or removed from the receiver when in a first position, and locking the receiver tube to the receiver when the receiver tube is rotated to a second position relative to the receiver; and an ear wax trap disposed in the receiver tube, the ear wax trap comprising a microporous membrane.

8. The apparatus of claim 7, further comprising:

a funnel disposed about the opening of the receiver and configured to guide the receiver tube into the opening.

* * * * *